US007166563B2

(12) United States Patent
Woodhead

(10) Patent No.: US 7,166,563 B2
(45) Date of Patent: Jan. 23, 2007

(54) BIOCIDAL CLEANING COMPOSITION COMPRISING AN ONIONIC/NONIONIC/AMPHOTERIC SURFACTANT MIXTURE

(75) Inventor: Peter Philip Woodhead, Cheshire (GB)

(73) Assignee: Selden Research Ltd. (GB)

( * ) Notice: Subject to any disclaimer, the term of this patent is extended or adjusted under 35 U.S.C. 154(b) by 0 days.

(21) Appl. No.: 10/469,637

(22) PCT Filed: Feb. 19, 2002

(86) PCT No.: PCT/GB02/00710

§ 371 (c)(1),
(2), (4) Date: Feb. 18, 2004

(87) PCT Pub. No.: WO02/070639

PCT Pub. Date: Sep. 12, 2002

(65) Prior Publication Data

US 2004/0248760 A1 Dec. 9, 2004

(30) Foreign Application Priority Data

Mar. 3, 2001 (GB) ..... 0105342.0

(51) Int. Cl.
*C11D 1/86* (2006.01)
*C11D 1/94* (2006.01)
*C11D 3/48* (2006.01)

(52) U.S. Cl. ..... 510/237; 510/235; 510/340; 510/351; 510/382; 510/384; 510/422; 510/470; 510/490; 510/504

(58) Field of Classification Search ..... 510/235, 510/237, 340, 351, 382, 384, 422, 470, 490, 510/504
See application file for complete search history.

(56) References Cited

U.S. PATENT DOCUMENTS

| | | | | |
|---|---|---|---|---|
| 4,748,158 | A | 5/1988 | Biermann et al. | |
| 5,503,779 | A * | 4/1996 | Adamy et al. | 510/427 |
| 5,576,284 | A * | 11/1996 | van Buskirk et al. | 510/384 |
| 5,614,180 | A * | 3/1997 | Chung | 424/70.19 |
| 5,646,100 | A * | 7/1997 | Haugk et al. | 510/131 |
| 5,719,113 | A * | 2/1998 | Fendler et al. | 510/382 |
| 5,734,029 | A * | 3/1998 | Wulff et al. | 536/4.1 |
| 5,951,991 | A * | 9/1999 | Wagner et al. | 424/401 |
| 5,994,286 | A * | 11/1999 | Desai et al. | 510/386 |
| 6,045,817 | A * | 4/2000 | Ananthapadmanabhan et al. | 424/405 |
| 6,083,517 | A * | 7/2000 | Ananthapadmanabhan et al. | 424/405 |
| 6,121,214 | A * | 9/2000 | Exner et al. | 510/130 |
| 6,339,057 | B1 * | 1/2002 | Knox et al. | 510/421 |
| 6,616,922 | B1 * | 9/2003 | Taylor et al. | 424/70.28 |
| 6,627,589 | B1 * | 9/2003 | Arvanitidou | 510/218 |
| 2002/0015716 | A1 * | 2/2002 | Jampani et al. | 424/401 |
| 2002/0022660 | A1 * | 2/2002 | Jampani et al. | 514/635 |
| 2002/0169099 | A1 * | 11/2002 | Knox et al. | 510/421 |

FOREIGN PATENT DOCUMENTS

| | | | |
|---|---|---|---|
| DE | 197 53 982 A | | 6/1999 |
| DE | 19753982 | * | 6/1999 |
| EP | 0 911 022 A | | 4/1999 |
| EP | 911022 | * | 4/1999 |
| EP | 0 934 742 A | | 8/1999 |
| WO | WO95 31962 A | | 11/1995 |

OTHER PUBLICATIONS

'Vantocil' IB, Zeneca, 4 pages; Jan. 4, 1994.
Cosmocilcq, Technical Information, 2 pages.

* cited by examiner

*Primary Examiner*—Charles Boyer
(74) *Attorney, Agent, or Firm*—McGuinness & Manaras LLP

(57) ABSTRACT

The present invention relates to a biocidal cleaning composition comprising a biocide, a surfactant of formula R—O—$(G)_n$, and an amphoteric surfactant; wherein R is an alkyl group; G is a saccharide residue; and n is a number from 0–4 to 10.

28 Claims, No Drawings

BIOCIDAL CLEANING COMPOSITION COMPRISING AN ONIONIC/NONIONIC/AMPHOTERIC SURFACTANT MIXTURE

The invention relates to biocidal cleaning compositions and more particularly but not exclusively to mild liquid formulations having utility in the manual cleaning and sanitising of dishes and hard surfaces.

There exists a continuing need for mild surfactants suitable particularly for manual dishwashing and other light duty hard surface cleaning applications, and such products have been the subjects of much prior art.

These products have generally comprised anionic and non-ionic surfactant blends conferring on them good foaming and drain drying properties so that crockery and glassware are rendered sparkling clean and streak free.

Furthermore, since the world's population is now more hygiene conscious than ever before it is desirable to produce a composition, which in addition to cleaning properties, also possesses antibacterial properties, and as such is suitable for sanitising hard surfaces, floors, walls, work surfaces and the like, especially in catering, food processing and health and hygiene situations where major health problems can arise due to the growth and spread of pathogenic bacteria.

These products have generally combined non-ionic surfactants with cationic biocides and/or organic halides often with higher alcohol co-solvents and chelating agents. They tend to be characterised by having relatively low foam and whilst they may have good grease removal, they are unsuitable for use in manual dishwashing applications as crockery and glassware are left with residual streaks and smears.

Previous attempts to combine both dishwashing and sanitising have met with limited success due to the incompatibility of anionic surfactants with cationic biocides such that their biocidal effectiveness has been much reduced. The use of organic halides or other biocides compatible with anionic surfactants has had limited success due to their ineffectiveness at high dilutions. Recent attempts to overcome these constraints have resulted in formulations having good dishwashing properties at normal use dilutions with biocidal properties when used neat or virtually neat.

Certain groups of non-ionic surfactants, particularly those based on sugars and vegetable oils for example alkyl polyglycosides (also known as alkyl polyglucosides and hereinafter referred to as APG's) are mild to the skin and have good foaming and rinsing properties. Moreover their detergency may be potentiated by combination with amphoteric surfactants. It is also known that they are compatible with some cationic surfactants. This has been utilised in the formulation of for example mouthwashes and skin and hair cleansers.

International Patent Application Nos. 94/05753, 95/31962 and European Patent Application No. 0911022A1 all teach of the use of APG's in such compositions.

APG'S have also been used as additives in manual dishwashing formulations to confer mildness usually in conjunction with anionic surfactants such as alkyl benzene sulphonate or sodium lauryl sulfate. The use of cationic biocides or biguanides in mouthwashes and skin cleansers and for example, surgical scrubs are also well known in the prior art and is described in U.S. Pat. Nos. 4,022,834 and 5,719,113.

However, the combination of sugar surfactants, amphoteric surfactants and quaternary biocides, or biguanides has not been previously applied to the production of a dishwashing composition having effective biocidal properties at normal use dilution.

Therefore, an object of the present invention is to provide a high performance surfactant solution with superior manual dish and glasswashing properties which also exhibits biocidal properties effective at normal use dilutions and is suitable for light duty hard surface cleaning/sanitising applications.

According to the present invention therefore, there is provided a biocidal cleaning composition comprising a biocide, a surfactant of formula I and an amphoteric surfactant.

Formula I wherein;

R=alkyl ($C_4$–$C_{24}$),

G=saccharide residue having 5 or 6 Carbon atoms, n=a number from 0.4 to 10.

In a preferred embodiment of the invention the biocide is water soluble, typically has some cationic properties and is normally either a biguanide or a quaternary ammonium compound. Suitable biguanides are referred to in U.S. Pat. Nos. 3,468,898 and 4,022,834 and are preferentially either a salt of chlorhexidine or polyhexamethylene biguanide (PHMB), as exemplified in formula II. Chlorhexidine is the common name for the antiseptic 1,1'-hexamethylene-bis-[-5-(4-chlorophenyl)-biguanide].

Formula II

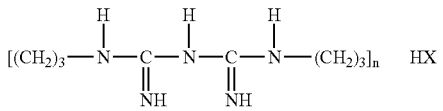

wherein;

HX is a salt forming anion n is a No. between 4 and 50, but preferably 12.

Suitable quaternary ammonium biocides are of formula III.

Formula III

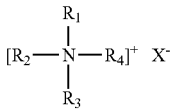

Where $R_1$ is selected from an alkyl group having 6 to 24 carbon atoms or aromatic, aryl or alkaryl groups having 6 to 24 carbon atoms; $R_2$, $R_3$ and $R_4$ are independently selected from hydrogen, an alkyl group having 1 to 24 carbon atoms, or aromatic, aryl or alkyaryl groups having from 6 to 24 carbon atoms; X is an anion selected from but not limited to chloride, bromide, iodide, acetate, phosphate, nitrate, sulphate, lactate, citrate, and mixtures thereof.

Th glycolate, saccharinate e biocide may constitute from 0.1% to 10% of the composition. Preferably, the biocide of the present invention shall constitute from 0.2% to 5% of the composition. Most preferably, the biocide of the present invention shall constitute from 0.5% to 2% of the composition.

The non-ionic surfactant, in accordance with formula I, is an APG.

Suitable APG's have been described in U.S. Pat. Nos. 3,839,318, 3,772,269, 3,707,535 and 3,547,828 also in German and European patents and are commercially produced by reacting glucose or oligosaccharides with alcohols containing from 4 to 24 carbon atoms under acid catalysis.

With higher alcohols high reaction temperatures and prolonged reaction times result in complex mixtures of mono-, di-, tri- and oligosaccharides and reference to APG's shall include complex mixtures as described.

A particular property of APG's is that although being formally classified as non-ionic surfactants they do exhibit very slight anionic behaviour. The APG's of the present invention may constitute from 5% to 35% of the composition. Preferably, the APG's of the present invention shall constitute from 10% to 20% of the composition.

It is well known in the art that amphoteric surfactants (also known as zwitterionic surfactants) show synergistic interactions with anionic surfactants. The present invention utilises a non-ionic surfactant with very mild anionic properties and the use of an amphoteric surfactant has been shown to improve the cleaning performance of APG's (Henkel sales brochure on their Glucopon range in April 1996). Since most classes of amphoteric surfactant are broadly compatible with the aforesaid biocides the nature of the amphoteric surfactant suitable for use in the present invention is not limited. Although the amphoteric surfactant may originate from a wide variety of sources those most suitable are derived from secondary and tertiary amines wherein the alkyl groups can be straight or branched alkyl chains between 1 and 22 carbon atoms long and may contain other functional groups, for example amido groups. Preferably the nitrogen of the amphoteric surfactant of the present invention shall be in a cationic state wherein, the number of cations present in the molecule shall not be limited.

At least one of the alkyl groups must contain an ionisable head group which can adopt a negative charge such as a carboxylate, sulphate, sulphonate, phosphate, phosphonate, succinate, or sulfosuccinate.

Preferably, the amphoteric surfactants shall be chosen from betaines, sultaines, hydroxysultaines, iminopropionates and iminodipropionates.

The amphoteric surfactant shall preferably constitute from 2% to 20% of the composition and advantageously from 5% to 15% of the composition.

The aforesaid constituents, (hereinafter referred to as the key formula) form the basis of the invention providing both washing ability and antibacterial activity, however, in order to optimise the performance of the present invention additional constituents may be added. Preferably, a non-ionic foam booster shall be added to the key formula for example, alkanolamides and amine oxides, for example alkyl amine oxides and ethoxylated amine oxides such as those available under the Aromox® range from Akzo Nobel Chemicals. The addition of these foam boosters has no detrimental effect on the biocidal efficacy of the present invention.

The foam booster may be added to the key formula in proportions not exceeding 10% of the composition.

Preferably, the foam booster shall be added to the key formula in proportions from 2% to 6% of the composition.

These classes of nitrogen containing nonionic surfactants are well known to show synergistic and foam boosting effects when used in conjunction with anionic surfactants. It has been found that they exhibit similar beneficial effects when used in conjunction with the mildly anionic APG's.

Preferably, anionic surfactants shall be added to the key formula in order to influence the feel, rinsing and foaming properties and without markedly reducing the bactericidal efficiency of the invention. The nature of the anionic surfactant is limited only by its compatibility with the key formula suitable anionic surfactants include sodium lauryl sulfate, sodium lauryl ether sulfate and sodium lauryl sarcosinate.

The aforesaid anionic surfactants may be tolerated by the key formula in proportions not exceeding 1% of the total.

Preferably, minor amounts of specific nonionic surfactants may be added to the key formula in order to improve grease removal. Suitable non-ionic surfactants include alcohol alkoxylates and alky phenol alkoxylates. Preferably, the non-ionic surfactants shall be an alchohol ethoxylate having a cloud point below 20° C. according to DIN 53917. The non-ionic surfactant may be included in the key formula in proportions not exceeding 10%.

Preferably, the non-ionic surfactant shall be included in the key formula in proportions not exceeding 5% of the total.

Advantageously, the non-ionic surfactant shall be included in the key formula in proportions between 1% and 3% of the total.

The pH of the composition shall be between 5 and 9, and may be adjusted by the additions of small amounts of acid or base.

Preferably, the pH of the composition shall be between 6 and 8.

The acid employed to adjust the pH of the composition is not limited but preferably shall be chosen from sulfamic, citric, hydrochloric, phosphoric, nitric, lactic, formic, acetic or gluconic but other mineral or organic acids may be used without detriment.

The base employed to adjust the pH of the composition is not limited but preferably shall be chosen from sodium or potassium hydroxide and mono-, di- or tri-ethanolamine but other bases may be used without detriment.

Furthermore, additional constituents may be added to the key formula including sequesterants, thickeners, perfume, dye and preservative. Careful selection of these ingredients is required since their inclusion is limited only by their compatability with the key formula.

The aforesaid additional constituents may be added to the key formula in proportions not exceeding 3% and preferably, not exceeding 1%.

It should be noted that common commercial detergents for manual dishwashing typically contain between 15% and 40% total surfactant content and the guideline inclusion rates described above are relevant to those typical detergent strengths. However, it is possible to manufacture very weak or very strong detergent solutions and any limits described above should be amended accordingly for such detergents.

Furthermore, the present invention is not based on petroleum derived stocks but rather on renewable resources such as coconuts, palm kernals and vegetable starch, and is therefore significantly more environmentally friendly both in terms of biodegradability and sustainability.

It is to be understood that all percentage values are measured by weight, and are relative to the total composition, unless otherwise stated.

This invention will now be described further by reference to the following specific examples:—

Formulation A

| CLASS OF COMPOUND | COMPOUND | AMOUNT ADDED (%) |
|---|---|---|
| Non-ionic surfactant | $C_{8-16}$ alkyl glycoside | 14.35 |
| Amphoteric surfactant | Cocoamidopropyl betaine | 10.62 |
| Non-ionic foam booster | Coconut diethanol-amide | 3.00 |
| Non-ionic surfactant | $C_{9-11}$ alcohol ethoxy-late (4EO) | 1.50 |
| Anionic surfactant | Sodium lauryl sulfate | 0.24 |
| Sequesterent | Tetrasodium EDTA | 0.30 |
| Biocide | PHMB hydrochloride | 0.90 |
| Cationic biocide | Alkyl trimethyl ammonium bromide | 0.45 |
| Acid | Sulfamic acid (to pH 6.5) | 0.33 |
| Perfume | Perfume | 0.25 |
| Dye | Dye | 0.005 |
| Water | Water | 68.06 |

The antimicrobial efficacy of formulation A was determined using standard testing procedures (BS 6471). Formulation A passed the standard test at a dilution of 1 part product to 200 parts water by volume.

Formulation B

| CLASS OF COMPOUND | COMPOUND | AMOUNT ADDED (%) |
|---|---|---|
| Non-ionic surfactant | $C_{8-16}$ alkyl glycoside | 14.32 |
| Amphoteric surfactant | Cocoamidopropyl betaine | 6.62 |
| Non-ionic foam booster | Coconut diethanol-amide | 2.99 |
| Non-ionic surfactant | $C_{9-11}$ alcohol ethoxy-late (4EO) | 1.50 |
| Non-ionic foam booster | Myristyl amine oxide | 3.99 |
| Anionic surfactant | Sodium lauryl sulfate | 0.24 |
| Sequesterent | Tetrasodium EDTA | 0.30 |
| Biocide | PHMB hydrochloride | 0.90 |
| Cationic biocide | Alkyl trimethyl ammonium bromide | 0.45 |
| Acid | Sulfamic acid (to pH 6.5) | 0.53 |
| Perfume | Perfume | 0.25 |
| Dye | Dye | 0.005 |
| Water | Water | 67.91 |

The antimicrobial efficacy of Formulation B was determined using standard testing procedures (BS 6471). Formulation B passed the standard test at a dilution of 1 part product to 400 parts water by volume.

In use these formulations in aqueous solution at a 1% dilution give rise to at least a 99% reduction in microbial activity when tested in accordance with BS 6471.

It will be appreciated that the above formulations are given by way of example only and that many variations are possible within the scope of the invention.

The invention claimed is:

1. A biocidal cleaning composition for washing dishes, capable of producing a reduction in microbial activity of 99% at a 1% aqueous dilution, comprising:

at least one water soluble biocide comprising cationic properties, an anionic surfactant added to the composition in an amount not exceeding 1% of the composition, an amphoteric surfactant comprising from 5% to 15% of the composition, and a surfactant comprising from 5% to 35% of the composition and having the formula:

$$R—O—(G)_n$$

wherein: R is an alkyl group, G is a saccharide residue, and n is a number from 0.4 to 10.

2. The biocidal cleaning composition of claim 1 wherein the saccharide residue comprises 5 or 6 carbon atoms.

3. The biocidal cleaning composition of claim 1 wherein the alkyl group has 4 to 24 carbon atoms.

4. The biocidal cleaning composition of claim 1 wherein the biocide is a biguanide.

5. The biocidal cleaning composition of claim 1 wherein the biocide is a quaternary ammonium compound.

6. The biocidal cleaning composition of claim 4 wherein the biguanide is a salt of chlorhexidine.

7. The biocidal cleaning composition of claim 4 wherein the biguanide is a salt of polyhexamethylene biguanide (PHMB) comprising the formula

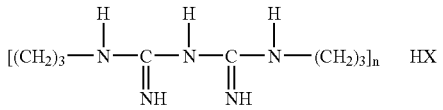

wherein: HX is a salt forming anion and n is number between 4 and 50.

8. The biocidal cleaning composition of claim 5 wherein the quaternary ammonium compound comprises the formula:

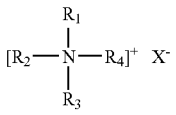

wherein:

$R_1$ is alkyl ($C_6$ to $C_{24}$), aromatic, aryl or alkaryl ($C_6$ to $C_{24}$)

$R_2$ is hydrogen, alkyl ($C_1$ to $C_{24}$), aromatic, aryl or alkaryl ($C_6$ to $C_{24}$)

$R_3$ is hydrogen, alkyl ($C_1$ to $C_{24}$), aromatic, aryl or alkaryl ($C_6$ to $C_{24}$)

$R_4$ is hydrogen, alkyl ($C_1$ to $C_{24}$), aromatic, aryl or alkaryl ($C_6$ to $C_{24}$)

X is chloride, bromide, iodide, acetate, phosphate, nitrate, sulfate, lactate, citrate, glycolate, saccharinate and mixtures thereof.

9. The biocidal cleaning composition of claim 1 wherein the biocide comprises from 0.1% to 10% of the composition.

10. The biocidal cleaning composition of claim 1 wherein the biocide comprises from 0.2% to 5% of the composition.

11. The biocidal cleaning composition of claim 1 wherein the biocide comprises from 0.5% to 2% of the composition.

12. The biocidal cleaning composition of claim 1 wherein the surfactant is an APG.

13. The biocidal cleaning composition of claim 12 wherein the APG comprises from 10% to 20% of the composition.

14. The biocidal cleaning composition of claim 1 wherein the amphoteric surfactant is derived from secondary or tertiary amines comprising straight or branched alkyl groups comprising between 1 and 22 carbon atoms.

15. The biocidal cleaning composition of claim 1 wherein the amphoteric surfactant comprises from 2% to 20% of the composition.

16. The biocidal cleaning composition of claim 1 further comprising an additional foam booster.

17. The biocidal cleaning composition of claim 16 wherein the foam booster comprises 10% or less of the composition.

18. The biocidal cleaning composition of claim 17 wherein the foam booster comprises from 2% to 6% of the composition.

19. The biocidal cleaning composition of claim 1 further comprising an additional non-ionic surfactant.

20. The biocidal cleaning composition of claim 19 wherein the non-ionic surfactant comprises a cloud point below 20° C.

21. The biocidal cleaning composition of claim 20 wherein the non-ionic surfactant comprises 10% or less of the composition.

22. The biocidal cleaning composition of claim 21 wherein the non-ionic surfactant comprises from 1% to 3% of the composition.

23. The biocidal cleaning composition of claim 1 wherein the composition comprises a pH of between 5 and 9.

24. The biocidal cleaning composition of claim 1 wherein the composition comprises a pH of between 6 and 8.

25. The biocidal cleaning composition of claim 1 further comprising at least one constituent selected from the group consisting of sequesterants, thickeners, perfumes, dyes, preservatives, and combinations thereof.

26. The biocidal cleaning composition of claim 25 wherein the concentration of the at least one constituent comprises less than or equal to 3% of the composition.

27. The biocidal cleaning composition of claim 26 wherein the concentration of the at least one constituent comprises less than or equal to 1% of the composition.

28. The biocidal cleaning composition of claim 4 wherein the biguanide is a salt of polyhexamethylene biguanide (PHMB) comprising the formula:

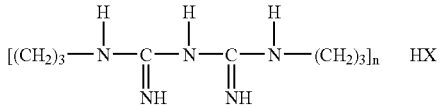

wherein HX is a salt forming anion and n is 12.

* * * * *